US005609431A

United States Patent [19]

Carroll

[11] Patent Number: 5,609,431

[45] Date of Patent: Mar. 11, 1997

[54] CLEANING MATERIAL WITH MATERIAL SUPPLY

[75] Inventor: Matthew B. Carroll, Dunellen, N.J.

[73] Assignee: Innovative Cleaning Concepts, Inc., Dunellen, N.J.

[21] Appl. No.: 298,605

[22] Filed: Aug. 31, 1994

Related U.S. Application Data

[60] Continuation-in-part of Ser. No. 197,237, Feb. 16, 1994, abandoned, which is a division of Ser. No. 923,240, Jul. 31, 1992, abandoned, which is a continuation-in-part of Ser. No. 448,668, Dec. 11, 1989, Pat. No. 5,134,746.

[51] Int. Cl.[6] ..... A47L 13/17

[52] U.S. Cl. ..... 401/201; 401/200

[58] Field of Search ..... 401/201, 200

[56] References Cited

U.S. PATENT DOCUMENTS

| | | | |
|---|---|---|---|
| 1,386,041 | 8/1921 | Wilson | 401/201 |
| 1,816,108 | 7/1931 | Blumenfeld . | |
| 1,924,147 | 6/1931 | Bates . | |
| 2,244,615 | 6/1941 | Garcin . | |
| 2,265,102 | 12/1941 | Cressler et al. . | |
| 2,548,255 | 4/1951 | Cressler . | |
| 2,637,870 | 5/1953 | Cohen . | |
| 2,690,661 | 10/1954 | Briggs . | |
| 2,717,437 | 9/1955 | DeMestral . | |
| 2,821,731 | 2/1958 | May . | |
| 3,066,347 | 12/1962 | Vosbikian et al. | 401/201 |
| 3,126,572 | 3/1964 | Franey . | |
| 3,151,333 | 10/1964 | Scholz . | |
| 3,175,331 | 3/1965 | Klein | 401/201 |
| 3,192,679 | 7/1965 | Cameron | 401/201 X |
| 3,214,777 | 11/1965 | Kutik . | |
| 3,414,928 | 12/1968 | Lemelson . | |
| 3,421,171 | 1/1969 | Tsuruzawa . | |
| 3,581,447 | 6/1971 | Falivene | 401/201 X |
| 3,634,901 | 1/1972 | Landsberg . | |
| 3,638,270 | 2/1972 | Schlegel, Jr. et al. . | |
| 3,643,386 | 2/1972 | Grzyll . | |
| 3,815,923 | 6/1974 | Goduto . | |
| 3,864,781 | 2/1975 | Leonard . | |
| 4,038,787 | 8/1977 | Bianchi . | |
| 4,051,572 | 10/1977 | Greenwood . | |
| 4,061,804 | 12/1977 | McCulloch . | |
| 4,065,826 | 1/1978 | Hough . | |
| 4,107,840 | 8/1978 | Kupperman et al. . | |
| 4,159,883 | 7/1979 | Mizell | 401/201 |
| 4,167,794 | 9/1979 | Pomeroy . | |
| 4,190,550 | 2/1980 | Campbell | 401/201 X |
| 4,356,220 | 10/1982 | Benedyk . | |
| 4,617,208 | 10/1986 | Cadenhead . | |
| 4,621,388 | 11/1986 | Ortolivo . | |
| 4,670,930 | 6/1987 | Lu . | |
| 4,672,706 | 6/1987 | Hill . | |
| 4,674,237 | 6/1987 | Sullivan | 401/201 X |
| 4,731,896 | 3/1988 | de La Tour . | |
| 4,884,374 | 12/1989 | Natale et al. . | |
| 4,953,250 | 9/1990 | Brown . | |
| 4,980,943 | 1/1991 | Barber . | |
| 5,022,517 | 6/1991 | Benitez . | |
| 5,040,260 | 8/1991 | Michaels . | |

FOREIGN PATENT DOCUMENTS

| | | | |
|---|---|---|---|
| 2278277 | 7/1974 | France . | |
| 2676166 | 11/1992 | France . | |
| 322089 | 6/1920 | Germany . | |
| 452131 | 5/1968 | Switzerland | 401/201 X |
| 585417 | 2/1947 | United Kingdom . | |

*Primary Examiner*—Steven A. Bratlie

*Attorney, Agent, or Firm*—Lerner, David, Littenberg, Krumholz & Mentlik

[57] ABSTRACT

A cleaning material designed for removing difficult stains and dirt from smooth and textured surfaces. The material is made of a plurality of flat chisel-like synthetic fibers which are somewhat pliant and protrude from a backing designed to hold the fibers in place. The material may be embodied in the shape of a mitt to fit over the hand of the user with a backing suitable to protect the user's hands. The material may also be configured in other fashions and in combination with different backings and attached to various instruments to provide greater ease of use for particular cleaning chores. Two inner layers of sponge, surrounding a soap or a chemical, can be surrounded by two outer layers of the cleaning material to form a pot scrubber pad. The inner and outer layers can be sealed by an ultrasonic welding technique.

14 Claims, 7 Drawing Sheets

CLEANING MATERIAL WITH MATERIAL SUPPLY

CROSS-REFERENCE TO RELATED APPLICATIONS

This is a continuation-in-part application of U.S. Ser. No. 08/197,237, filed Feb. 16, 1994, now abandoned, which is a divisional application of U.S. Ser. No. 07/923,240, filed Jul. 31, 1992, now abandoned, which is a continuation-in-part application of U.S. Ser. No. 07/448,668, filed Dec. 11, 1989, now U.S. Pat. No. 5,134,746, issued Aug. 4, 1992.

FIELD OF THE INVENTION

This invention provides for an effective cleaning material which is nonabrasive and ideally suited for difficult stains on smooth or slightly textured and delicate surfaces in addition to being useful for a multitude of less demanding cleaning tasks.

Heretofore, when cleaning delicate surfaces a choice had to be made between effective but abrasive cleaning materials (such as steel wool) with the potential for damaging the surface cleaned, or cleaning with a non-abrasive material (such as cloth or sponge) that would not damage the surface but would prove ineffective on many types of caked-on dirt. Synthetic materials have fallen short of this need because of the shape of the fibers.

The more effective cleaning materials work well because of the rigidity and hardness of the material (e.g. steel wool, wire brushes, sandpaper) because they will not yield to or roll over a caked-on stain. However, the very unyielding quality of such a cleaning material tends to also be unyielding to the surface being cleaned and would damage a delicate surface. In addition the more rigid the material the more limited is the ability to produce forms of the material that would lend themselves to ease of use. On the other hand, nonabrasive materials that would be safe for delicate surfaces due to their soft and yielding quality (e.g. sponges, cloths, and circular fibered synthetics) are not effective to many caked-on stains because they will yield to or roll over the dirt. Therefore, most users would find it desirable to have a single cleaning material that would facilitate efforts to remove caked-on stains and dirt from delicate surfaces without damaging the surface to be cleaned in addition to being useful on a number of less demanding dirt and surface combinations. Heretofore this need has not been adequately addressed.

Accordingly, this invention is designed to address the need for an effective cleaning material for tough cleaning chores involving delicate surfaces as well as being suitable to many less demanding cleaning problems. The invented material is made of a plurality of flat chisel-like synthetic fiber tufts protruding from a backing designed to hold the fiber tufts in place. The synthetic fibers are flat and cut on their ends in a manner to produce in effect a small chisel or razorblade-like plastic. The fibers are somewhat flexible in order to allow them to lie down parallel to the surface to be cleaned. At the same time their roughly rectangular shape provides an inflexible cleaning edge in the direction that is perpendicular to any dirt that protrudes above the surface. The effect of this combination of qualities allows the invention to effectively remove any stain on the surface of the material that is being cleaned. The material and structure of the invented material allows it to yield to the surface to be cleaned which lies parallel to the cleaning material, but be very unyielding to any dirt that obtrudes from the surface which in turn will be perpendicular to the cleaning material. This action not only allows the invented material to more effectively clean many combinations of surfaces and dirt that can already be addressed by currently available material, but also to effectively clean many combinations of surface and stains that heretofore were difficult or impossible. The wide range of cleaning materials currently available are proportionately abrasive to both the dirt to be removed and the surface to be cleaned thereby creating a tradeoff decision to be made by the user between effective dirt removal and potential of damage to the surface to be cleaned. Specifically, the invented material is the only non-chemical cleaning material that effectively and safely removes tar and bird stains from automobile finishes, bugs from windshields, calcium deposits from shower tiles and doors, scuff marks from no-wax floors, algae stains from vinyl and tile pool surfaces, barnacles from fiberglass boats, and similar tough cleaning tasks.

In addition, the basic invented material can be manufactured with various backings and formed in numerous ways so that the finished tool will be ideally suited to a specific cleaning task. E.g. steel wool would be difficult to form into the shape of a glove.

In addition, the invented material is nonabsorbent and inert so that cleaning chemicals can be easily rinsed out and the small amounts of water retained by surface tension can be released by a simple shaking of the material. This allows for rapid drying and quick storage without the danger of mildew. Sponges and cloths must be thoroughly rinsed and dried prior to storage to avoid mildewing and are easily subject to staining and mildewing.

In addition, the invented material can be used much like a brush on more textured surfaces by simply applying less pressure. Heretofore, it was necessary to have a wide range of cleaning materials to attempt to address the multitude of cleaning chores that are adequately addressed by the invented material.

In addition, since many cleaning chores require increased absorption characteristics, the invented material may be manufactured with an absorbent backing or with the addition of an absorbent material incorporated into the surface to provide the desired amount of absorption.

In addition, many chemicals can be used in combination with the invented material without damage. Heretofore, adverse chemical reactions could result when using certain cleaning materials in combination with certain chemicals.

Further, the material can be utilized in a variety of ways and for a variety of applications. For instance, the material can be used in connection with cleaning pads, cleaning wipes, cleaning sponges, bottle cleaning sponges, shoe scrubbing pads, toilet bowl scrubbers, animal grooming scrubbers, skin abraders, back brushes, golf ball and club cleaning pads, toothbrushes, denture cleaning brushes, fish scalers, etc.

As an animal grooming scrubber, the material is effective in removing hair from animals, such as horses, dogs, etc., without the pulling of knotted hair often caused by a standard animal brush. The reason for this is that the tufts are short and flexible and will bend and yield when a knot is encountered. The material will retain a sufficient quantity of the animal's hair until the user wishes to remove this hair by going back against the material "grain".

As a skin abrader, the material is extremely effective in washing human skin without unnecessary harshness. Because of its open cleaning edges much less force is required to remove dirt and grime. The material removes grease and oil from hands with only soap and without using expensive or harsh chemicals. The material chemically attracts petroleum based chemicals, and will also clean under the nails because of its open cut design. It also provides a pleasant sensation and stimulation to the human skin.

In summary, the invented material provides an effective cleaning solution to many tasks that were heretofore difficult or impossible and also provides the user with a multipurpose cleaner incorporated into one convenient device.

The material is superior to other cleaning materials in that it is formed in such a manner that it provides three straight cleaning edges for every piece of protruding material—the end and two sides. With multiple tufts per square inch and multiple fibers per tuft, the material provides for thousands of cleaning edges on the cleaning surface of the material. This maximizes cleaning efficiency and minimizes the force to effectively clean a surface, item, etc.

Heretofore, when cleaning delicate surfaces such as non-stick cookware, tiles, chrome, etc., a choice had to be made between effective but abrasive cleaning pads (such as steel wool). The potential for damage of the surface being cleaned with an abrasive cleaning pad often resulted in the selection of a non-abrasive pad (such as a cloth or sponge) that would not damage the surface but would not effectively clean the surface. The more effective cleaning pads work well because of the rigidity and hardness of the material (for example steel wool, hard roughened plastics, etc.). Such materials will not yield to or merely move over hard-to-remove dirt. Also, such cleaning pads are often woven or compressed such that they entrap the dirt being removed from the surface being cleaned. The pads thus accumulate dirt and food particles that are not easily removed with rinsing and which promote the growth of germs and bacteria while the cleaning pad is not in use. This causes the cleaning pad itself to be unclean and cause unhealthy cleaning conditions or disposal of the cleaning pad before its useful mechanical life has been spent.

The present invention includes a pot scrubber pad which can be used for effective cleaning even delicate surfaces, while allowing the dirt or food particles removed from the surface to be easily rinsed away. The pot scrubber pad in accordance with the present invention includes a sponge for retaining soaps, polishes or chemicals. The preferred embodiment includes two sponges to encapsulate soap powder or other cleaning materials. Preferably, the entire outside of the pad will be covered with flat chisel-like synthetic fiber tufts. The fibers making up the tufts are somewhat flexible in order to allow them to lie parallel to the surface being cleaned. Thus, the fibers of the pad in accordance with the present invention yield to the surface being cleaned, but will not yield to any dirt that obtrudes from this surface, since such dirt will be, in effect, perpendicular to the cleaning material.

Further objects and advantages of the invention will become apparent from a consideration of the drawings and the ensuing description.

FIG. **8*a*** shows a manner in which the invented material could be combined with an absorbent material with the two surfaces at right angles to one another and attached to a handle to be used as a mop.

FIG. **8*b*** shows another manner in which the invented material could be combined with an absorbent material with the two surfaces at right angles to one another and attached to a handle to be used as a mop.

Figure 9:
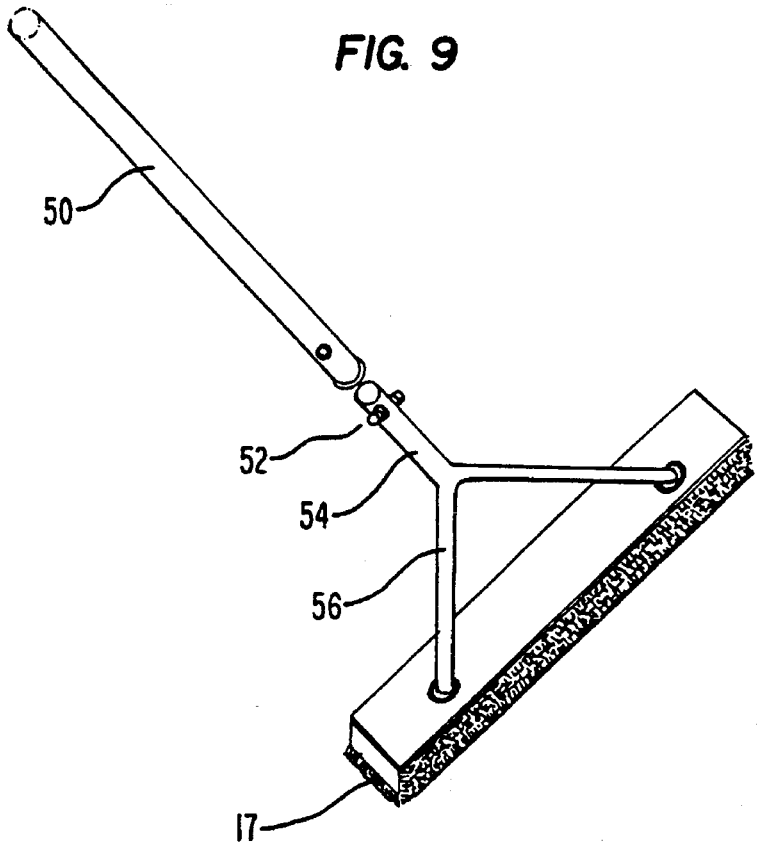

FIG. 9 shows a manner in which the invented material may be attached to an extended pole which may be used for cleaning pools or other areas where an extension is desirable.

Figure 10:
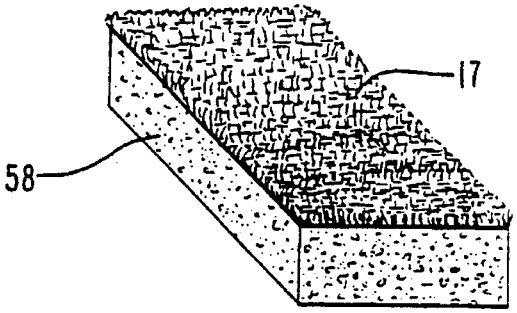

FIG. 10 shows a manner in which the invented material is applied to the surface of a sponge.

Figure 11:
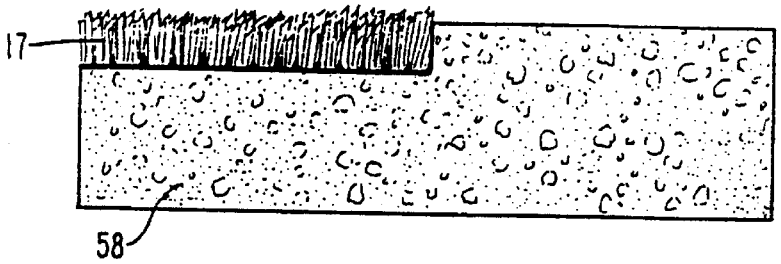

FIG. 11 shows the manner in which the invented material may be combined with an absorbent material on the same surface to provide both cleaning and drying within one surface.

Figure 12:
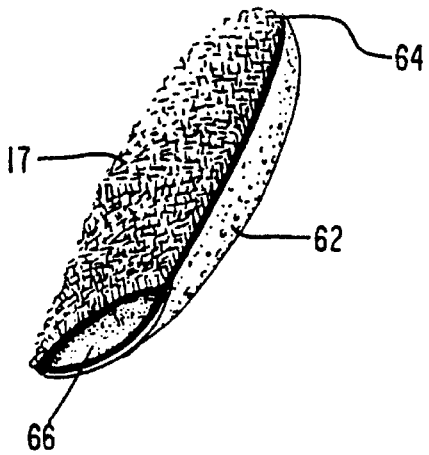

FIG. 12 shows a manner in which the invented material may be formed into a mitt form with a pocket for the hand with one surface of the mitt being comprised of the invented material and the reverse surface of the mitt being of an absorbent material.

Figure 13:
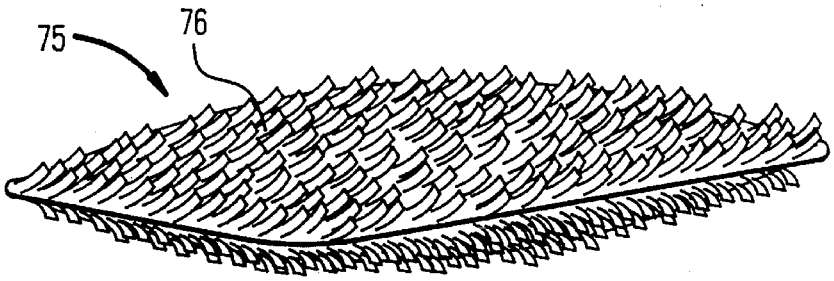

FIG. 13 is a perspective view of a pot scrubber pad in accordance with another embodiment of the present invention.

Figure 14:
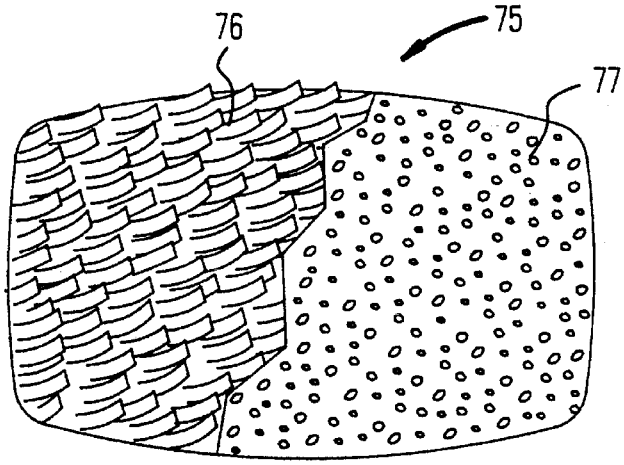

FIG. 14 is a top plan view, in partial section, of the pot scrubber pad in FIG. 13.

Figure 15:
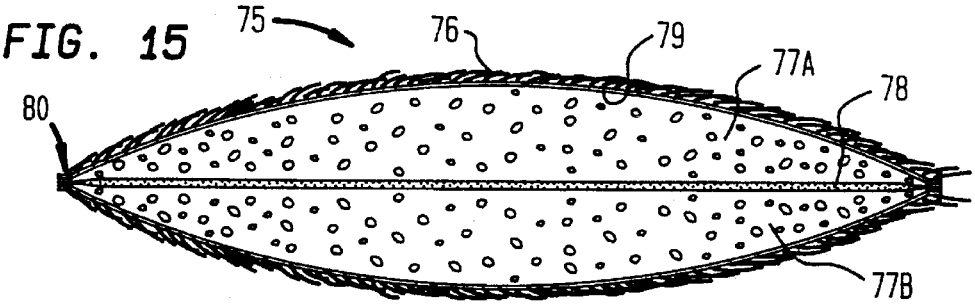

FIG. 15 is a cross-sectional elevational view of the pot scrubber pad in FIG. 13.

Figure 16:
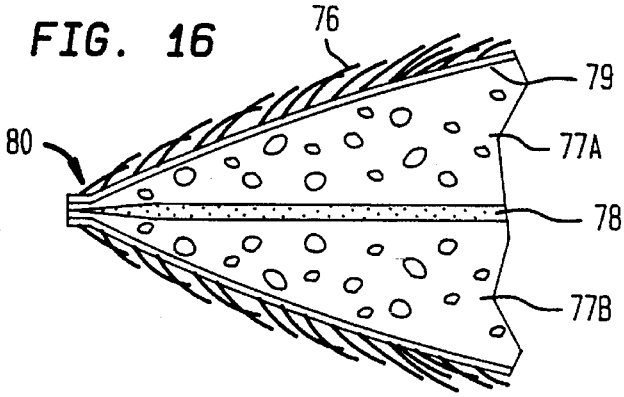

FIG. 16 is an enlarged partial cross-section of the pot scrubber pad in FIG. 13, illustrating in particular the welded connection of four layers of material.

DESCRIPTION OF THE PREFERRED EMBODIMENT OF THE INVENTION

Figure 1:
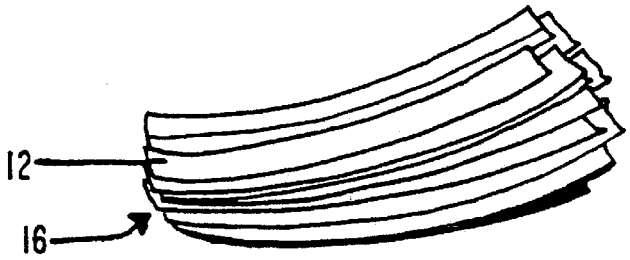
FIG. 1 is an perspective view of a group of flat cleaning fibers at a magnification of 4 times actual size showing the varying dimensions of individual cleaning fibers within a tuft. Magnification is 3×.

The invented material is made of a plurality of flat chisel-like synthetic fiber tufts protruding from a backing designed to hold the tufts in place. The synthetic fibers are flat and cut on their ends in a manner to produce in effect a small chisel or razorblade-like plastic. The fibers are somewhat flexible. FIG. 1 shows a group of individual fibers (12) combined into a tuft (16) lying flat prior to tufting. The fibers (12) are made of an extruded polypropylene yarn which may be fiberlated to create varying widths of fibers. The length of the fibers (12) is approximately 0.75 inches and vary in width from 0.02 to 0.12 inches.

Figure 2:
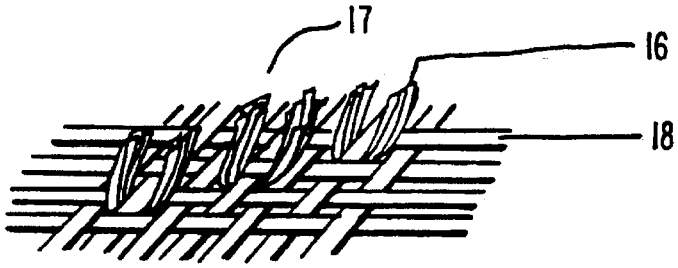
FIG. 2 shows a group of fibers or tuft as placed within the scrim in such a way to provide two front cleaning edges per fiber on the cleaning surface and placed at a slight angle from perpendicular to the plane of the scrim. This is at magnification 2×.

FIG. 2 shows approximately twenty of these various widthed fibers are joined into a group or tuft (16) and then temporarily positioned through a woven polypropylene backing or 'scrim' (18) in such a fashion that both ends protrude at a slight angle from the cleaning surface (17).

Figure 3:
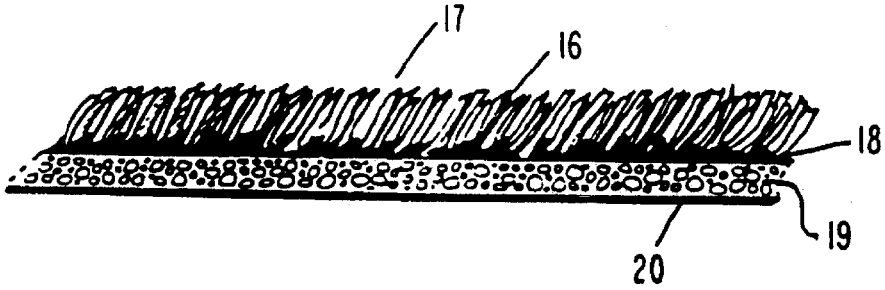
FIG. 3 shows the application of an extruded or glued backing to hold the tufts in their correct position and secondarily provide protection for the hand. The inclusion of an optional absorbent layer is also shown. Magnification is 2×.

FIG. 3 shows that approximately fifty of these tufts (16) are placed within one square inch of the surface (17) of the invented material. This method creates about 2000 small plastic fibers per square inch (20 fibers per tuft times 2 ends per fiber times 50 tufts per square inch). The tufts (16) are held in place by an extruded backing (20). The drawing also depicts the potential inclusion of an absorbent material (19) if desired.

The material in accordance with the present invention must include several characteristics which are often difficult to impart to a material during manufacture, especially in the aggregate. The material and its backing must be flexible, durable, resistant to chemicals, water, wear and tear, etc. It cannot deteriorate under use and/or leave particles of the polypropylene flat fibers and backing on the surface being cleaned. The tufts of fibers must be locked in place with the backing, the material must be flexible and non-flaking, as well as water resistant and soft to the touch. The backing of the material is important in this regard. It can provide the lock for the tufts of fiber and/or the water resistant and soft features. These are features not provided with, for instance, indoor/outdoor carpet.

The tufted material is constructed with a liquid compound and/or adhesive, which when cured, will mechanically, and at least to some extent chemically, lock the tufts of flat fibers in place such that the material will not deteriorate easily by physical wear or when in contact with common cleaning chemicals. A final interior layer of a soft fabric can be added to the material (either during the curing stage or thereafter) so as to provide a soft feel for hand use products such as a cleaning mitt or cleaning pads. The compound used to create this backing is made up of the following parts by percentage of dry weight, the application of these various ingredients varying by application (for instance, more flexible or less flexible):

| INGREDIENT | PERCENT PREFERABLY USED | PREFERABLE RANGE |
|---|---|---|
| Natural or Synthetic Latex | 53% | 30% to 100% |
| Filler | 43% | 0% to 70% |
| Thickener | 3% | 0% to 15% |
| Plasticizer | 1% | 0% to 10% |

The natural or synthetic latex should be used without excessive additives, such as clay or other debilitating agents, which although reduce the cost of manufacture, create an inferior backing (such as those used on conventional carpet backings).

An example of a filler which can be used for the backing is calcium carbonate. An example of the thickener which can be used for the backing is polyacrylate salt. Finally, an example of the plasticizer which can be used is a product referred to in the interest as D.O.P.

Of course, other similar or equivalent ingredients or additives may be used in place of the above or in addition to the above.

In the alternative, the plastic tufts can be "locked" with the use of an adhesive or an intermediate compound which would create a mechanical or chemical lock with the tufts and a chemical or mechanical bond with the liner.

Once again in the alternative, an impermeable liner can be preformed by dipping a mold into natural or synthetic latex.

Still further in the alternative, a method of manufacturing, for instance, the cleaning mitt, would be to coat the tufted fiber with a vinyl-based, solid or cellular, compound or another compound that would be sealable through the use of radio frequency sealing, ultrasonic sealing, or some similar method of sealing. This coating process would create a mechanical lock on the fibers and create a waterproof lining. The coating would preferably average between 0.002 inches and 0.2 inches in thickness, though any suitable thickness is contemplated. The mitt could then be formed by radio frequency sealing two or more parts (for instance the top and bottom portion of the mitt) from the outside in, without effecting the plastic cleaning tufts. In this manner, one could complete a waterproof seal along the radio frequency sealed edge, thereby providing complete protection to the hand.

Figure 4:
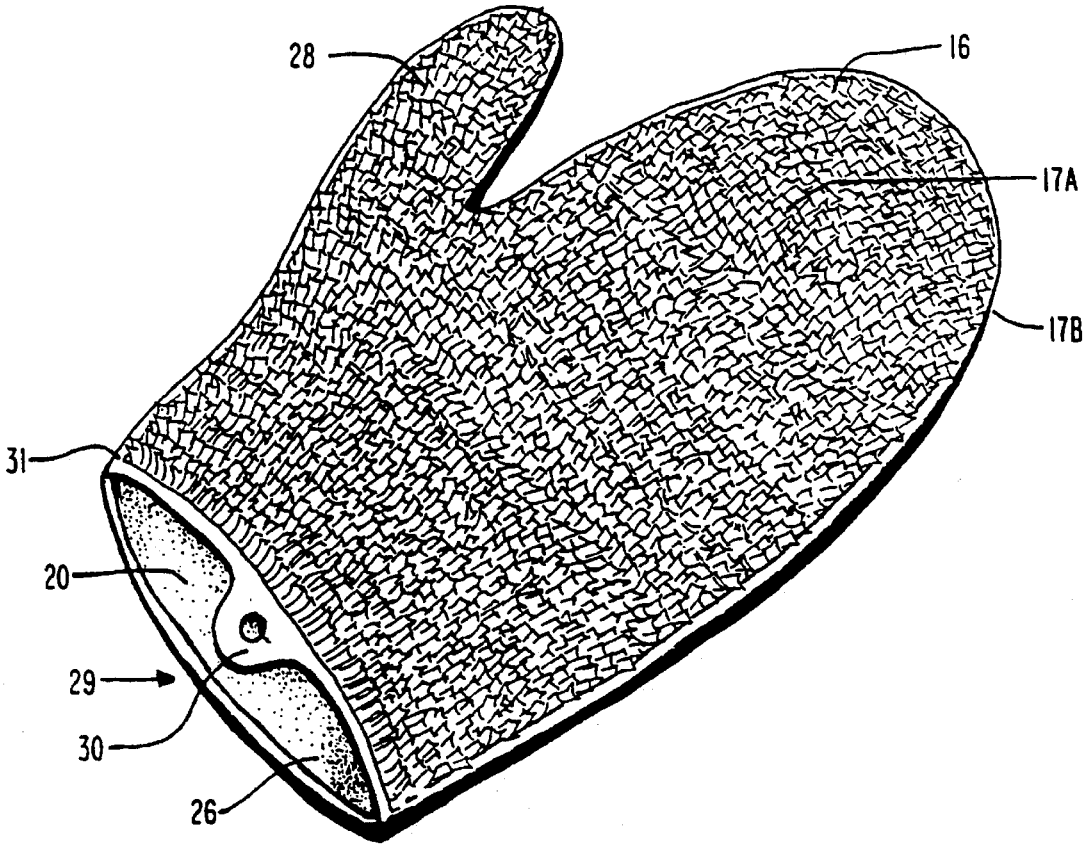
FIG. 4 is a perspective view of the mitt embodiment of the invented material showing the opening of the mitt, the protective liner, and the hanging hole. There is a separate pocket for the thumb to allow more dexterity in use. The unseen opposite (right-handed) side of the mitt also has the invented material facing outward and it would be the mirror image of this drawing. This provides an equivalent left-handed mitt in the same embodiment. Magnification is ½×.

FIG. 4 is a perspective view of a mitt embodiment of the invented material showing the opening (29) of the mitt and the protective liner (20) and left-hand primary cleaning surface (17*a*). Two layers of the invented material with backing are placed back to back and sealed in the shape of an oven mitt with a pocket designed for the four fingers (26) and a separate pocket for the thumb (28) with the addition of a hole (30) designed for hanging the glove. The seam (31) is continuous around the outside of the mitt except across the opening provided for the hand (29). The final result being an ambidextrous cleaning glove. The unseen bottom surface (17*b*) in this drawing would be the primary cleaning surface for a right-handed person.

Figure 5:
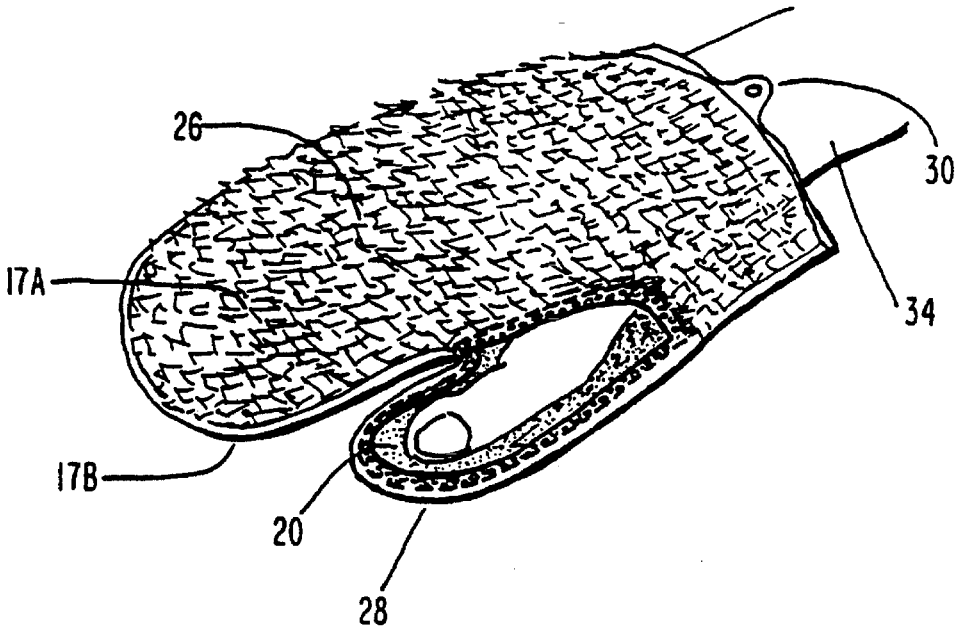
FIG. 5 shows a cutaway view of the mitt with the hand placed inside protected by the liner from the cleaning surface.

FIG. 5 shows a cutaway view of the mitt with the placement of the user's hand (34) inside. In this drawing a right hand is being used and the primary cleaning surface would be facing down (17*b*). If a left hand were used the drawing would be identical with the exception that the palm of the hand would be facing up and the primary cleaning surface would be that which is facing up (17*a*).

Figure 7:
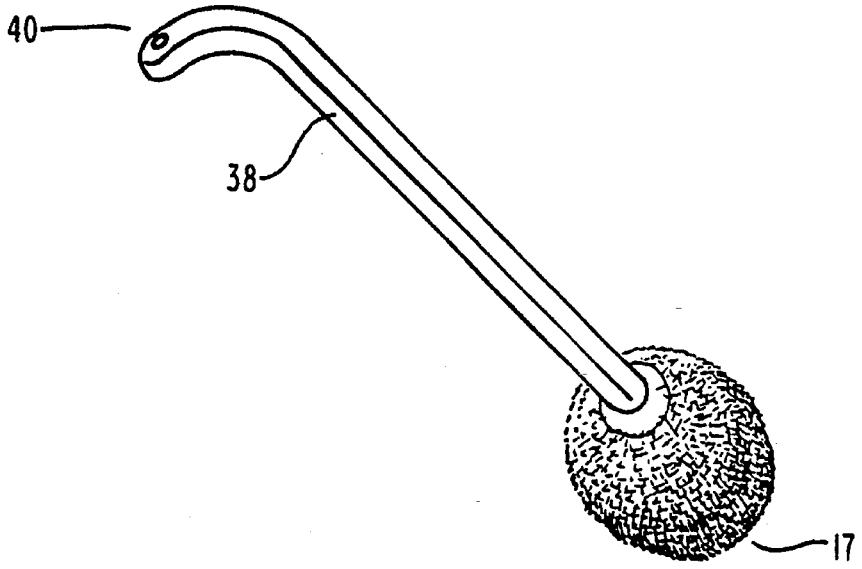
FIG. 7 shows a manner in which the invented material may be attached to a handle.

FIG. 7 shows one manner in which the invented material (17) may be attached to a handle (38) with a hanging hole (40) incorporated.

Figure 8A:
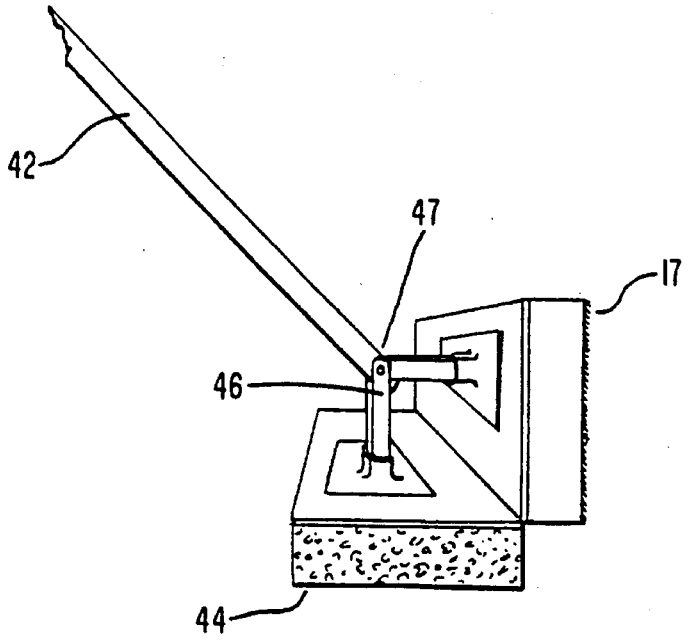

FIG. 8*a* shows a manner in which the invented material (17) could be combined with an absorbent material (44) with the two surfaces at right angles to one another. The two surfaces would be fixed in this position by a supporting base frame (46) and both surfaces would be fixed at an angle of approximately 45 degrees to the pole (42) via a hinged or unhinged joint (47).

Figure 8B:
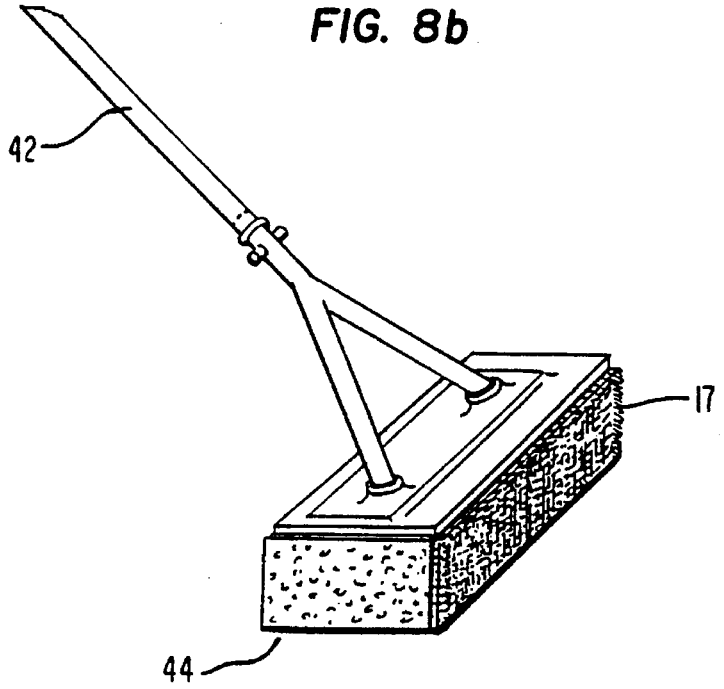

FIG. 8*b* shows another manner in which the invented material (17) could be combined with an absorbent material (44) with the two surfaces at right angles to one another and attached to a handle (42).

FIG. 9 shows a manner in which the invented material (17) may be attached to a frame (56) which frame may be used as an attachment for standard hollow pool or vacuum cleaner poles (50) utilizing depressible locking pegs (52) attached to the neck (54) of the frame (56) of the attachment.

FIG. 10 shows a manner in which the invented material (17) would be attached to the surface of a sponge or other absorbent material (58).

FIG. 11 shows the manner in which the invented material (17) may be combined with an absorbent material (58) on the same surface.

FIG. 12 shows a manner in which the invented material (17) may be formed into a mitt form with a pocket (64) for the hand, with one surface of the mitt being comprised of the invented material (17) and the reverse surface (62) of the mitt being of an absorbent material with a protective liner (66) incorporated inside the pocket.

FIGS. 13–16 show a pot scrubber pad in accordance with another embodiment of the present invention. The pot scrubber pad is generally designated as 75, and includes cleaning fibers 76 which are of the same construction as the synthetic flat fibers 12 described above. FIG. 14 illustrates that the pot scrubber pad 75 includes the outer surface with the fibers 76, as well as a sponge on the inside. The entire exterior surface of the pot scrubber pad 75 includes the cleaning fibers 76. The sponge 77 is for the purpose of retaining liquids, such as water, and/or cleaning solutions such as soap. FIG. 15 shows a cross-sectional view of the pot scrubber pad in which there are two sponges 77A and 77B. While only one sponge is necessary to carry out the present invention, it is preferable to employ two sponges 77A and 77B which surround a soluble soap, chemical or polish. In the preferred embodiment, soap is provided in the form of granulated soap powder 78 which will dissolve with water.

As in previous embodiments, tufts of the fibers 76 are formed and held with a polypropylene backing or scrim 79. An adhesive holds the tufts of fiber 76 within the scrim 79. However, unlike certain of the foregoing embodiments, waterproofing or resistancy is not encouraged. Thus, an impermeable coating would not be used. The flow of liquids through the scrim encourages the soap to dissolve completely prior to the use of the pad 75 to clean a pot, dish or other item. This differs from the pasty soap film often resulting from the use of steel wool pad. Thus, undissolved soap will not be deposited on the item to be cleaned, resulting in the easy rinsing of such item. When undissolved soap is deposited on an item to be cleaned, extra effort is required to remove the unwanted soap, often in the form of a paste, from the item being cleaned. In fact, sealing the powder soap within the pocket formed between the sponges substantially reduces or eliminates the possibility of powder flaking out of the pad 75 before use. Thus, flaking soap or a film of pasty soap will not be transferred to the user's hand prior to the actual use of the pad 75. Moreover, the pad 75 will last longer than other scrubbing pads, since soap will not be wasted. Moreover, the pad 75 will save water since additional water will not be required to remove unwanted soap paste from an item being cleaned.

As explained in connection with other embodiments, the fibers 76 facilitate a non-scratching cleaning action, and only temporarily trap dirt and food, as the pad 75 is easy to rinse. As compared to other pot scrubbing pads, such as steel wool pads, the pad 75 will not rust, will last longer and will be more pleasant to the touch as it is not as messy as conventional pot scrubbing pads.

The present embodiment contemplates the use of a granulated soap powder. Other types of soaps may be used between the sponges 77A & 77B, but it has been found that the granulated soap powders are more effective since only undissolved soap will be placed on the item to be cleaned. The soap itself should be suitable for cleaning pots, pans, dishes, cups, etc. Also, the soap should foam—that is, create bubbles with its use—to facilitate the cleaning process. Preferably, the soap should be slow dissolving in order to provide longer use. Lastly, the soap should not interfere with the process of sealing the sponge and fiber/scrim layers, as explained below. The soap should also be non-chlorinated. Another advantage of using soap powder is that it will only dissolve upon use. Liquid soaps may dry and may not readily dissolve after drying.

The pad 75 can be made through the layering of the required materials. Since the fiber/scrim layer should be on both sides or all sides of the pad 75, layers of these materials will form the top and bottom layers. A sponge 77 will be sandwiched between the fiber/scrim layers, or in the preferred embodiment, two sponges 77A & 77B will be sandwiched between the fiber/scrim layers. In the preferred embodiment, the soap powder 78 should be sandwiched between the sponge 77A and sponge 77B. An alternative arrangement would be the use of one single sponge 77 sandwiched by the fiber/scrim layers, with no soap or a soap deposited in the sponge itself.

In any event, once the requisite layers are arranged, which is preferably in the form of large sheets of the requisite materials, an ultrasonic welding process or radio frequency sealing process may be employed to form individual pads 75. Of course, the pads can be of any suitable size, but are preferably about the same size as a conventional steel wool pad. A particular advantage of this manufacturing process is the sealing of all layers together around the outer perimeter of the pad 75. FIG. 16 shows in greater detail than previous figures the sealing of the layers or the fiber/scrim layers and sponge layer 77A & 77B. The sealing connection, generally designated as 80 in FIG. 16, provides for the sealed entrapment of the soap powder 78 between the sponges 77A & 77B. Only a single ultrasonic welding pass need be made to seal all four layers with the soap therebetween. The manufacturing process is thus fast and results in the simultaneous sealing of all four layers.

In use, the user would hold the pad 75 in his or her hand in any position that is comfortable. The user would wet the pad 75 to release the polish, chemical or soap and apply the pad across the surface to be cleaned, polished or otherwise treated. If water is not required in a specific application, the user may squeeze the pad to release the polishing or other special chemicals through the scrim 79 and onto the fibers 76. The pad 75 with polishing or other special chemicals can then be applied to the surface to be cleaned, polished, etc. After use, the pad 75 can be rinsed and squeezed dry, where any dirt or liquid on the fibers may be rinsed or shaken off. The pad 75 will then be relatively dry and available for the next use.

Operation of the Invention

Figure 6:
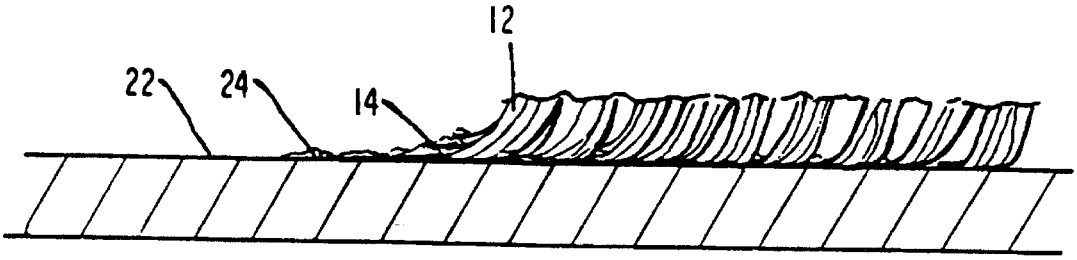
FIG. 6 shows the manner in which the invented material works upon a dirty surface. Note that the plurality of flat fibers are at right angles to the dirt but parallel to the surface to be cleaned.

In the preferred embodiment of the invention the user would apply water and/or chemicals if desired to either the surface to be cleaned or to the invented material itself. The surface of the material would then be applied to the surface to be cleaned and rubbed back and forth to remove dirt and stains. FIG. 6 shows the operation of the fibers (12) upon the surface to be cleaned (22). The chisel-like fibers (12) have some flexibility along the axis of the length of the fibers which allows them to lay down parallel to the surface to be cleaned and thereby present the cutting edge of the fiber at a perpendicular to the dirt to be removed (24). The fibers are very inflexible along the axis of their width due to their shape and their being secured in the backing. This in turn allows no place for the fiber to go upon encountering the dirt except to go through it. This works in much the same way that a flexible metal ruler would lay down next to a table top but would not yield left or right when pushing the ruler forward across the table. The relative thinness of the fibers combined with pressure applied by the user is such that the path of least resistance for the cutting edge is to undercut the dirt or stain next to the surface, The dirt then rides up and over the fiber and is temporarily trapped between fibers. Upon releasing the pressure between fibers by removing the invented cleaning material from the surface, the fibers will tend to return to their original shape and release any entrapped dirt. Rinsing and shaking the material will release most of the dirt and the material may be easily placed to dry and be available for the next use. Thus the reader will see that the invention provides a convenient and effective cleaning material that can be used for both some specific cleaning chores that heretofore were not adequately addressed by currently available cleaning materials and provide one convenient material for a multitude of more conventional cleaning tasks.

In the mitt embodiment of the invention the user would place either hand into the mitt with the thumb placed separately from the four fingers. The user would then apply the cleaning method stated above and upon finishing hang the mitt up by utilizing the hanging hole. In the mitt embodiment the tufts are held in place by a laminated backing which also serves to provide an impermeable layer to liquids, and provide a soft texture to protect the user's skin, and provide a method to allow for manufacturing by way of thermal impulse melting or glueing.

In the short handled embodiment of the invention the user would grasp the handle and then utilize the cleaning method as described above for the cleaning of toilets and other inaccessible or particularly dirty chores.

In the long handle or mop embodiment of the invention the user would use the device in much the way as an ordinary mop with the added action that the user would first apply the surface of the invented material to the surface to be cleaned and after loosening all stubborn stains and dirt the user would turn the handle 180 degrees in order to present the absorbent surface of the mop to the surface allowing easy clean up of the loosened dirt and liquid.

In the extended or pool cleaning embodiment of the invention the user would attach the invented material attachment to the pole in much the same manner as done with conventional attachments and apply the invented material to the surface to be cleaned as stated above.

In the sponge backed embodiment of the invention the user would first apply the surface of the invented material to the surface to be cleaned and after loosening all stubborn stains and dirt the user would turn the device over in order to present the absorbent surface of the mop to the surface allowing easy clean up of the loosened dirt and liquid.

In the embodiment of the invention that combines an absorbent material on the same surface as the invented material the user would both scrub and absorb with the single surfaced device.

In the embodiment of the invention that combines an absorbent material on one side and the invented material on the second side of a mitt the user would first apply the surface of the invented material to the surface to be cleaned and after loosening all stubborn stains and dirt the user would turn the device over in order to present the absorbent surface of the mitt to the surface allowing easy clean up of the loosened dirt and liquid.

I claim:

1. A cleaning pad comprising a first outer layer and a second outer layer, at least said first outer layer being made of a cleaning material having plurality of flat synthetic fibers and a backing which fixes said flat fibers such that said flat fibers will not flake off of said cleaning material during use, each said fiber being attached to said backing such that most of the fibers thereof extend at a slight angle to said backing, said second outer layer being made of material other than a sponge material, two absorbent sponge layers disposed between said first outer layer and said second outer layer, and soap between the said two absorbent sponge layers, said first and second outer layers being sealed together such that said absorbent sponge layers and said soap are not removable from between said first and second outer layers.

2. The cleaning pad in claim 1, wherein the flat fibers are made of polypropylene and the backing includes a woven scrim.

3. The cleaning pad in claim 1, wherein said soap is powdered and slow dissolving.

4. The cleaning pad in claim 1, wherein both said first outer layer and said second outer layer are made of said cleaning material.

5. The cleaning pad in claim 4, wherein said first outer layer, said second outer layer and said absorbent sponge layers are attached to one another about the perimeter of said cleaning pad such that the absorbent sponge layers are sealed together between said outer layers.

6. The cleaning pad in claim 5, wherein said outer layers and said sponge layers are attached together by ultrasonic welding.

7. The cleaning pad in claim 4 wherein at least said outer layers are sealed by ultrasonic welding.

8. A cleaning pad comprising a first outer layer and a second outer layer, at least said first outer layer being made of a cleaning material having a plurality of flat synthetic fibers and a backing which fixes said flat fibers such that said flat fibers will not flake off of said cleaning material during use, each said fiber being attached to said backing such that most of the fibers thereof extend at a slight angle to said backing, said second outer layer being made of material other than a sponge material, two absorbent sponge layers disposed between said first outer layer and said second outer layer, and chemical or polish between the said two absorbent sponge layers, said first and second outer layers being sealed together such that said absorbent sponge layers and said chemical or polish are not removable from between said first and second outer layers.

9. The cleaning pad in claim 8, wherein said chemical is soluble.

10. The cleaning pad in claim 8, wherein the flat fibers are made of polypropylene and the backing includes a woven scrim.

11. The cleaning pad in claim 8, wherein both said first outer layer and said second outer layer are made of said cleaning material.

12. The cleaning pad in claim 11, wherein at least said outer layers are sealed by ultrasonic welding.

13. The cleaning pad in claim 11, wherein said first outer layer, said second outer layer and said absorbent sponge layers are attacked to one another about the perimeter of said cleaning pad such that the absorbent sponge layers are sealed together between said outer layers.

14. The cleaning pad in claim 13, wherein said outer layers and said sponge layers are attached together by ultrasonic welding.

* * * * *

UNITED STATES PATENT AND TRADEMARK OFFICE

CERTIFICATE OF CORRECTION

PATENT NO. : 5,609,431

DATED : March 11, 1997

INVENTOR(S) : Matthew B. Carroll

It is certified that error appears in the above-identified patent and that said Letters Patent is hereby corrected as shown below:

Column 10, line 4, after "having" insert --a--.

Column 10, line 60, "attacked" should read --attached--.

Signed and Sealed this

First Day of July, 1997

Bruce Lehman

*Attest:*

BRUCE LEHMAN

*Attesting Officer*

*Commissioner of Patents and Trademarks*